US006380893B1

(12) United States Patent
Chang et al.

(10) Patent No.: US 6,380,893 B1
(45) Date of Patent: Apr. 30, 2002

(54) GROUND-BASED, WAVEFRONT-PROJECTION BEAMFORMER FOR A STRATOSPHERIC COMMUNICATIONS PLATFORM

(75) Inventors: Donald C. D. Chang, Thousand Oaks; Kar Yung, Torrance; Frank A. Hagen, Palos Verdes Estates; Weizheng Wang, Rancho Palos Verdes, all of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/655,041

(22) Filed: Sep. 5, 2000

(51) Int. Cl.[7] ..... H01Q 3/22

(52) U.S. Cl. ..... 342/373; 342/372; 342/354; 342/157

(58) Field of Search ..... 342/373, 372, 342/354, 157

(56) References Cited

U.S. PATENT DOCUMENTS

| | | | | |
|---|---|---|---|---|
| 4,635,063 A | | 1/1987 | Chang et al. | 342/380 |
| 5,017,927 A | * | 5/1991 | Agrawal et al. | 342/371 |
| 5,077,562 A | | 12/1991 | Chang et al. | 342/368 |
| 5,218,619 A | | 6/1993 | Dent | 375/1 |
| 5,550,809 A | | 8/1996 | Bottomley et al. | 370/18 |

(List continued on next page.)

OTHER PUBLICATIONS

Chiba, Isamu et. al, "Digital Beam Forming (DBF) Antenna System for Mobile Communications",IEEE AES Systems Magazine, Sep. 1997, pp. 31–41.

Miura, Ryu et. al, "A DBF Self–Beam Steering Array Antenna for Mobile Satellite Applications Using Beam–Space Maximal–Ratio Combination", IEEE Trans. On Vehicular Technology, vol. 48, No. 3, May 1999, pp. 665–675.

Sato, Kazuo et al., "Development And Field Experiments of Phased Array Antenna For Land Vehicle Satellite Communications", IEEE Antennas and Propagation Society International Symposium, 1992, Jul. 1992, vol. 2, pp. 1073–1076.

Sakakibara, Kunio et. al, "A Two–Beam Slotted Leaky Waveguide Array for Mobile Reception of Dual–Polarization DBS", IEEE Transactions on Vehicular Technology, vol. 48, No. 1, Jan. 1999, pp. 1–7.

Suzuki, R. et. el, :Mobile TDM/TDMA System With Active Array Antenna, Global Telecommunications Conference, 1991; Globecom '91, vol. 3, Dec. 2–5, 1991, pp. 1569–1573.

U.S. application No. 09/611,753, Chang et al., filed Jul. 7, 2000.

U.S. application No. 09/655,498, Chang et al., filed Sep. 5, 2000.

U.S. application No. 09/655,041, Chang et al., filed Sep. 5, 2000.

K. K. Chan, F. Marcoux, M. Forest, L. Martins–Camelo, "A Circularly Polarized Waveguide Array for Leo Satellite Communications", pp. 154–157, IEEE 1999 AP–S International Symposium, Jun. 1999.

M. Oodo, R. Miura, Y. Hase, "Onboard DBF Antenna for Stratospheric Platform", pp. 125–128, IEEE Conference on Phased Array Systems and Technology, California, May 21–25, 2000.

Yokosuka Research Park, "The First Stratospheric Platform Systems Workshop", pp. 1–216, May 12–13, 1999.

*Primary Examiner*—Theodore M. Blum
(74) *Attorney, Agent, or Firm*—V. D. Duraiswamy; M. W. Sales

(57) ABSTRACT

A method for beamforming signals for an array of receiving or transmitting elements includes the steps of selecting a beam elevation and azimuth and grouping elements of an antenna array into element ensembles that are substantially aligned with a wavefront projection on the antenna array corresponding to the selected beam elevation and azimuth.

33 Claims, 6 Drawing Sheets

U.S. PATENT DOCUMENTS

| | | | | |
|---|---|---|---|---|
| 5,555,257 | A | | 9/1996 | Dent ..... 370/95.1 |
| 5,572,216 | A | | 11/1996 | Weinberg et al. ..... 342/357 |
| 5,594,941 | A | | 1/1997 | Dent ..... 455/13.4 |
| 5,612,701 | A | | 3/1997 | Diekelman ..... 342/354 |
| 5,810,284 | A | | 9/1998 | Hibbs et al. ..... 244/13 |
| 5,856,804 | A | | 1/1999 | Turcotte et al. ..... 342/371 |
| 5,903,549 | A | | 5/1999 | Von der Embse et al. .. 370/310 |
| 5,909,460 | A | | 6/1999 | Dent ..... 375/200 |
| 5,917,447 | A | * | 6/1999 | Wang et al. ..... 342/383 |
| 5,949,766 | A | | 9/1999 | Ibanez-Meier et al. ..... 370/316 |
| 5,973,647 | A | | 10/1999 | Barrett et al. ..... 343/713 |
| 6,111,542 | A | | 8/2000 | Day et al. ..... 342/359 |
| 6,147,658 | A | | 11/2000 | Higashi et al. ..... 343/853 |
| 6,151,308 | A | | 11/2000 | Ibanez-Meier et al. ..... 370/316 |

* cited by examiner

GROUND-BASED, WAVEFRONT-PROJECTION BEAMFORMER FOR A STRATOSPHERIC COMMUNICATIONS PLATFORM

BACKGROUND OF THE INVENTION

The present invention relates generally to beamformers for arrays of receiving or transmitting elements. More specifically, but without limitation thereto, the present invention relates to ground-based digital beamforming for stratospheric communications platforms.

In ground-based digital beam forming, the individual element signals of an antenna array on a stratospheric platform are linked with a ground station so that the beamforming calculations may be performed by hardware that is not subject to the power, size, and weight constraints of the stratospheric platform. In conventional digital beamforming methods, each element signal is multiplied by a different phasor corresponding to a selected beam, for example $e^{j\theta_i}$, where $\theta_i$ is a phase angle calculated for each element i. The phasor products are then summed to form the selected beam. The phasors are selected so that signals arriving from a preferred direction add substantially coherently, while signals arriving from other directions add incoherently. The result is a spatial discrimination favoring signals arriving from the preferred direction and a corresponding enhancement of their signal-to-noise ratio. A problem with conventional digital beamformers is the requirement of a phasor multiplication for each element signal, typically $N^2$ for an N×N array. A reduction in the number of multiplications required would save processing time and resources that could be dedicated to other tasks.

SUMMARY OF THE INVENTION

The present invention advantageously addresses the needs above as well as other needs by providing a method and apparatus for beamforming signals for an array of receiving or transmitting elements.

In one embodiment, the present invention may characterized as a method for beamforming that includes the steps of selecting a beam elevation and azimuth and grouping elements of an antenna array into element ensembles that are substantially aligned with a wavefront projection on the antenna array corresponding to the selected beam elevation and azimuth.

In another embodiment, the present invention may characterized as a beamformer that includes a beam selector for selecting a desired beam elevation and azimuth and an ensemble selector for grouping elements of an antenna array into element ensembles that are substantially aligned with a wavefront projection on the antenna array corresponding to the selected beam elevation and azimuth.

The features and advantages summarized above in addition to other aspects of the present invention will become more apparent from the description, presented in conjunction with the following drawings.

BRIEF DESCRIPTION OF THE DRAWINGS

The above and other aspects, features and advantages of the present invention will be more apparent from the following more specific description thereof, presented in conjunction with the following drawings wherein.

Corresponding reference characters indicate corresponding elements throughout the several views of the drawings.

DETAILED DESCRIPTION OF THE DRAWINGS

The following description is presented to disclose the currently known best mode for making and using the present invention. The scope of the invention is defined by the claims.

The following example of a stratospheric platform application is used by way of illustration only. Other applications may include other digital beam forming arrays.

Figure 1:
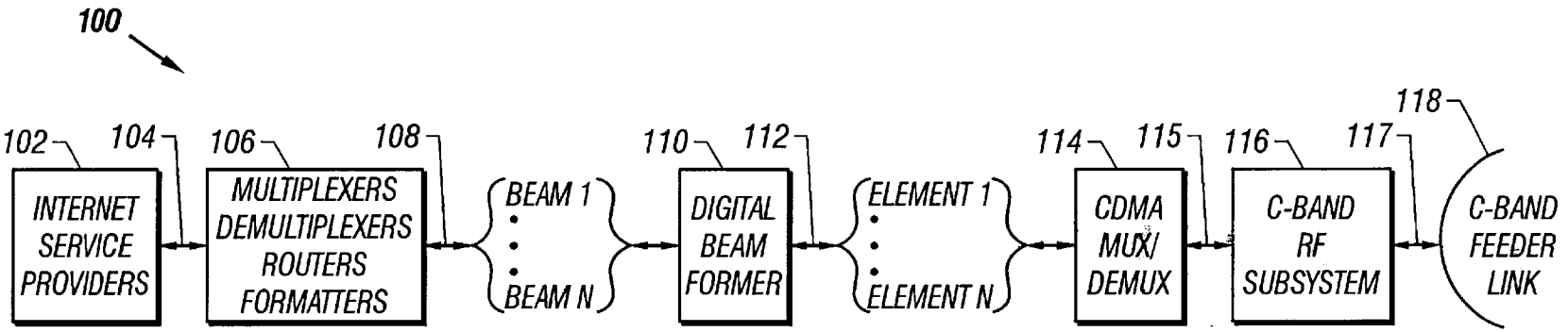
FIG. 1 is a block diagram of a ground station segment of an exemplary communications gateway according to an embodiment of the present invention.

FIG. 1 is a block diagram of a ground station segment 100 of an exemplary communications gateway according to an embodiment of the present invention. Shown are Internet service providers 102, communications traffic 104, a data processor 106, beam signals (beams 1 through N) 108, a digital beamformer 110, antenna element signals (antenna elements 1 through M) 112, a code division multiple access multiplexer/demultiplexer 114, code division multiple access data 115, a C-band (or X-band) RF subsystem 116, C-band signals 117, and a C-band feeder link 118.

To simplify referencing in the figures, indicia are used interchangeably for signals and their connections. The reference 104 thus represents both communications traffic to and from the Internet service providers 102 and the connection shown between the Internet service providers 102 and the data processor 106. The data processor 106 performs multiplexing, demultiplexing, routing, and formatting of the beam signals 108 according to well-known techniques. The beam signals 108 are received as input to the digital beamformer 110 when transmitting signals or output from the digital beamformer 110 when receiving signals. The digital beamformer 110 inputs or outputs the element signals 112 corresponding to the beam signals 108. The digital beamformer 110 may be implemented using well-known techniques or as a wavefront projection beamformer described below. A code division multiple access (CDMA) multiplexer/demultiplexer 114 processes each antenna element signal 112 appropriately to/from the RF subsystem 116 according to well-known techniques. The C-band RF subsystem 116 inputs/outputs CDMA signals 115 and transmits/receives C-band signals 117 to/from the C-band feeder link 118 that links the antenna element signals 112 between the ground station segment 10 and an antenna array on a stratospheric platform.

Figure 2:
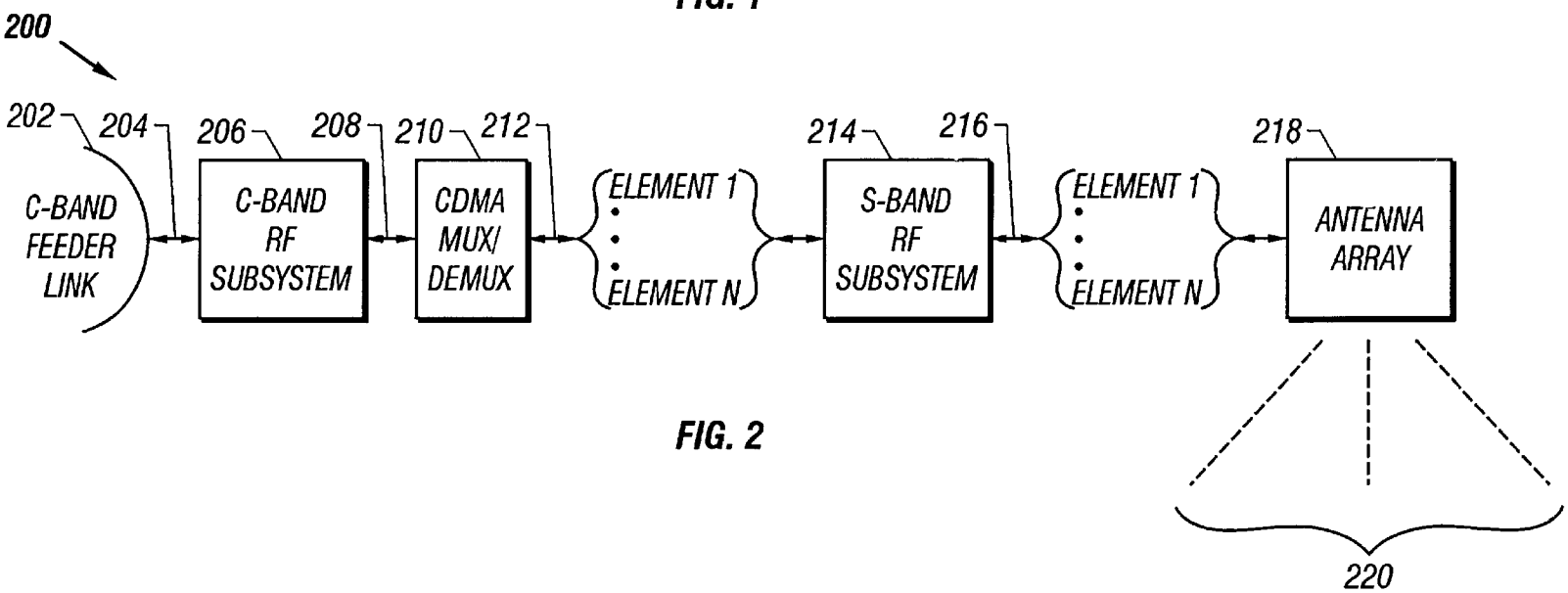
FIG. 2 is a block diagram of a stratospheric platform segment of a communications gateway linked to the ground segment of FIG. 1.

FIG. 2 is a block diagram of a stratospheric platform segment 200 of the communications gateway linked to the ground station segment 100 of FIG. 1. Shown are a C-band (or X-band) feeder link 202, C-band signals 204, a C-band RF subsystem 206, code division multiple access signals 208, and a code division multiple access multiplexer/demultiplexer 210 similar to those of FIG. 1.

The antenna element signals 212 are received as input to the S-band RF subsystem 214 when transmitting a signal and output from the S-band RF subsystem 214 when receiving a signal. The S-band RF subsystem 214 amplifies and filters the antenna element signals 212 and transmits or receives the S-band signals 216 corresponding to the element signals 212 between the antenna array 218 and service subscribers via the selected beams 220.

Figure 3:
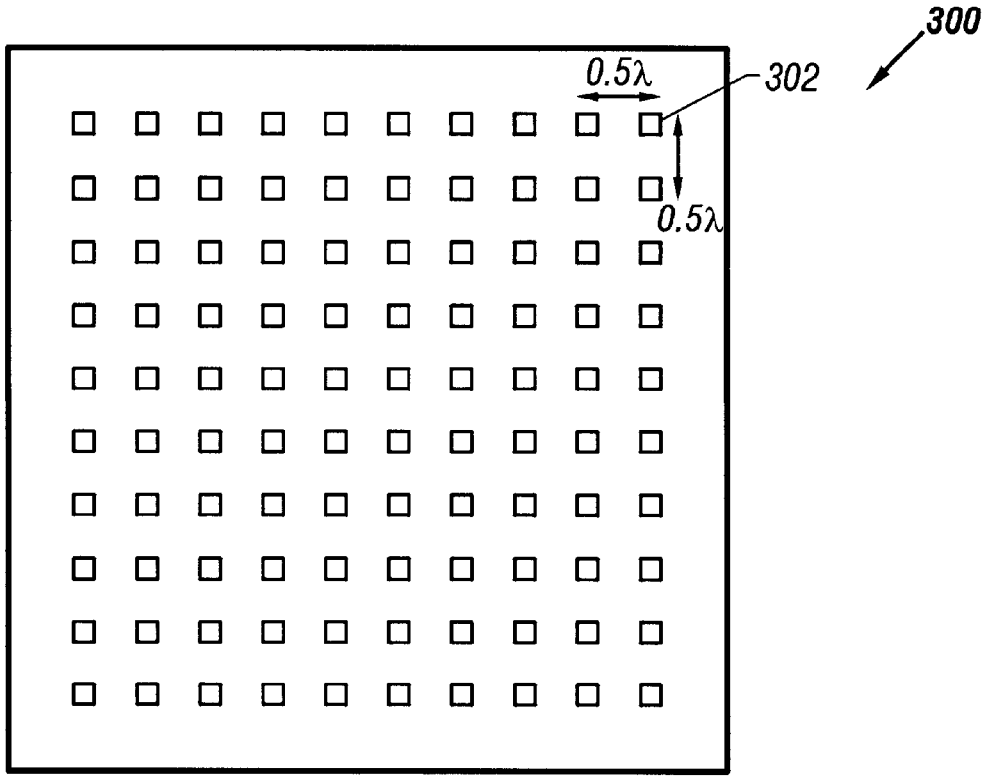
FIG. 3 is a diagram of a stratospheric platform patch antenna array for the stratospheric platform segment of FIG. 2.

FIG. 3 is a diagram of a patch antenna array 300 as an example of the antenna array 218 in FIG. 2, although other arrays for receiving or transmitting signals may be also used to practice the invention in various applications. In this example, 100 patch antenna elements 302 are arranged in a square lattice spaced about 0.5 wavelength apart so that the antenna array 30 spans about five wavelengths in both the X and Y dimensions. A typical operating frequency for the S-band user link is about 2 GHZ, which corresponds to an array aperture of about 75×75 $cm^2$. The operation of the antenna array 30 is assumed to be reversible between transmit and receive modes, thus the beamforming method of the present invention applies both to transmitting and receiving signals.

According to conventional antenna theory, the expected maximum gain from the antenna array 30 of a boresight beam is about 22 dB. With an element weighted tapering to control sidelobes, a typical gain for a boresight beam is about 20 dB while the gain of each individual element is about 2 dB. In conventional ground-based digital beam forming, each element signal is multiplied by a different phasor corresponding to a selected beam, for example $e^{j\theta_i}$, where $\theta_i$ is a phase angle calculated for each element i for a selected beam. The present invention further enhances the advantages of ground-based beam forming explained above by a method that advantageously reduces the number of multiplications performed for each beam.

Figure 4:
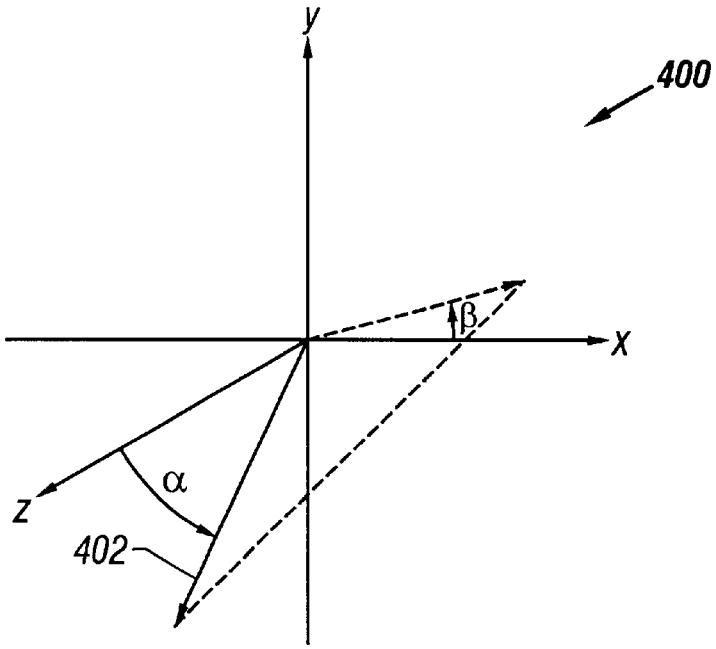
FIG. 4 is a diagram of a convenient coordinate system for defining a beam for the antenna array of FIG. 3.

FIG. 4 is a diagram of a convenient coordinate system 400 for defining a beam direction 402 for the antenna array 300 of FIG. 3. The X-Y plane is parallel to the antenna array 30, and the Z-axis points in the direction of a boresight beam. The angle between the Z-axis and the direction of an off-axis beam is defined as the elevation angle α. The angle between the projection of the beam on the X-Y plane and the X-axis is defined as the azimuth angle β.

Figure 5:
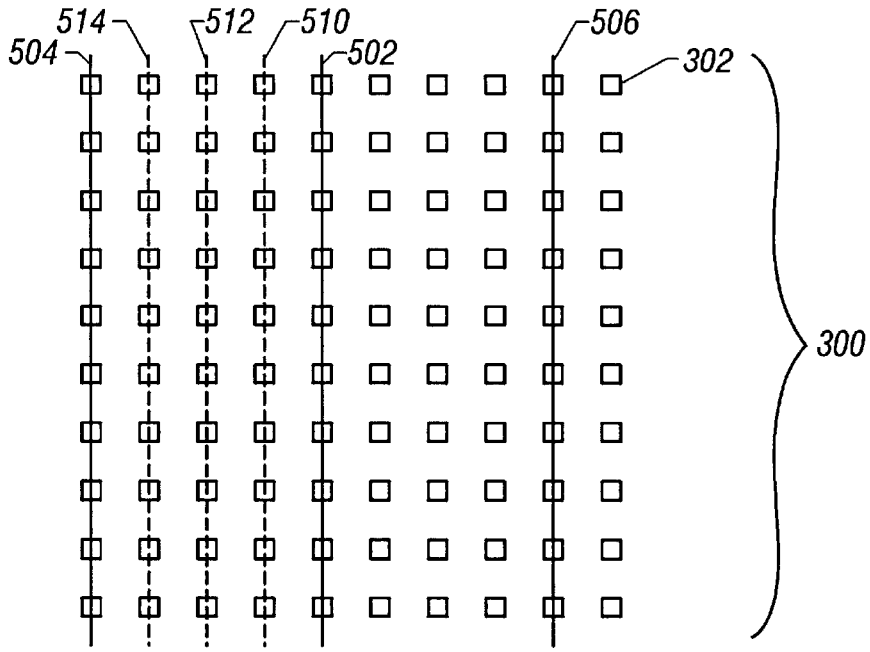
FIG. 5 is a diagram of a wavefront projection on the patch antenna array of FIG. 3 from sources at multiple directions all at an azimuth $\beta=0°$ relative to the X-axis.

FIG. 5 is a diagram of a wavefront projection on the patch antenna array 300 of FIG. 3 from sources at multiple directions all at β=0° relative to the X-axis. In this example, the beam direction 402 is given by the coordinates α=−30° and a β=0°. At a given instant in time, a wavefront projection 502 from this direction intersects the plane of the antenna array 300 along a line parallel to the Y-axis. As the signal wavefront propagates, the wavefront projection 502 moves from left to right. By definition, the phase of the signal at all points along the wavefront projection 502 is the same, and the leading and trailing wavefront projections 504 and 506 at integer multiples of the signal carrier wavelength all have the same phase. The wavefront projections 502, 504, and 506 are parallel to the Y-axis and are separated by the wavelength divided by the sine of the elevation angle α. In this example, the separation is twice the wavelength. Because the signal phase is the sane along the-wavefront projections 502, 504, and 506, ensembles of antenna elements 302 that coincide with each of the wavefront projections 502, 504, and 506 may be defined and the corresponding antenna element signals may be summed directly without the usual step performed by current beamformers of multiplying each antenna element signal by a separate phasor. Instead, all the elements in each element ensemble are located along a wavefront having the same phase for a signal in the desired beam direction and are compensated by the same amount in the beamformer. The sum of the element signals for each ensemble is called a projection, and the phase compensated projection is called a phase weighted projection. For receiving signals, the beam signal is the sum of the phase weighted projections. As a result of performing the projection before the phase compensation, the phase weighting step is reduced from a two-dimensional calculation to a one-dimensional calculation. Consequently, the number of multiplications is advantageously reduced from N×N to N.

Figure 6:
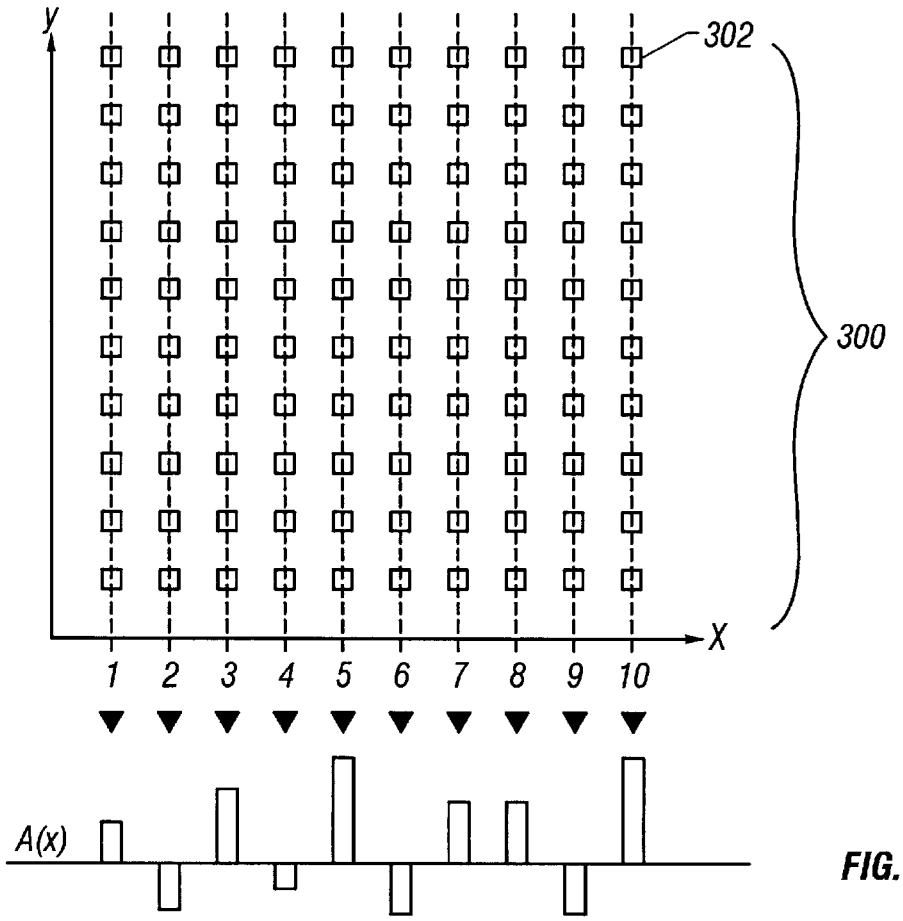
FIG. 6 is a diagram of the wavefront projection on the patch antenna array of FIG. 3 from a source at an azimuth $\beta=0°$ relative to the X-axis illustrating signal phase variation across antenna array element ensembles.

FIG. 6 is a diagram of a wavefront projection on the patch antenna array 300 of FIG. 3 parallel to the Y-axis illustrating wavefront signal amplitude A(x) as a function of phase variation across element ensembles. $A(x_1)$ is the sum of signals of all elements in the element ensemble at $x=x_1$. In the general case where the signal phase period projected on the aperture may not be the same as the period of the antenna array lattice, only 10 multiplications are required instead of the 100 multiplications performed by other beamformers. In this example, a beam $S_\alpha(t)$ may be formed according to the formula $$S_\alpha(t)=A(x_1)+A(x_2)e^{j\Delta\alpha}+A(x_3)e^{j3\Delta\alpha}+\ldots+A(x_{10})e^{j\Delta 10\alpha} \quad (1)$$

where the phase progression increment Δα is given by $$\Delta\alpha=\frac{2\pi}{\lambda}d\sin\alpha \quad (2)$$

and d is the element spacing.

In the example of FIG. 5 where α=−30° and d=0.5λ, the phase difference between adjacent columns is given by $$\Delta\alpha=\frac{2\pi}{\lambda}d\sin\alpha=-\frac{\pi}{2}\text{rad}=-90 \quad (3)$$

There are ten wavefront projections $A(x_i)$ to be multiplied by ten phasors, but only four different phasor values (1, $e^{j\pi/2}$, $e^{j2\pi/2}$, $e^{j3\pi/2}$) before summing to arrive at beam $S_\alpha(t)$. The phasors are sequentially periodic, and every fourth phasor has the same value.

If α=−45° and d=0.5λ, the phase increment between adjacent columns is given by $$\Delta\alpha=\frac{2\pi}{\lambda}d\sin\alpha=-\frac{\pi}{\sqrt{2}}\text{rad}\cong-127 \quad (4)$$

Here wavefront periodicity projected across the array does not match with the lattice period of the array, and a phase increment of −127° must be added progressively to the phase compensation of each successive projection $A(x_i)$ as i ranges from 1 to 10. There are therefore ten different phases that will be multiplied by $A(x_i)$ before summing to arrive at beam $S_\alpha(t)$.

If $\alpha=0°$ and $d=0.5\lambda$, the phase difference between adjacent columns is given by $$\Delta\alpha = \frac{2\pi}{\lambda} d \sin\alpha = 0° \tag{5}$$

Because there is no phase progression across the array for a boresight beam, the element signals may be summed without any phase compensation to arrive at beam $S_\alpha(t)$.

When $\beta=0°$ or $90°$, each ensemble along a wavefront has the same number of elements, and ensemble sums may be defined respectively by sums of signals from single columns and rows of antenna elements. Depending on the elevation angles, the periodicity and the phase difference between element ensembles varies. By properly adjusting the phase increment applied to each element ensemble, a beam may be formed for any desired elevation angle $\alpha$.

Figure 7:
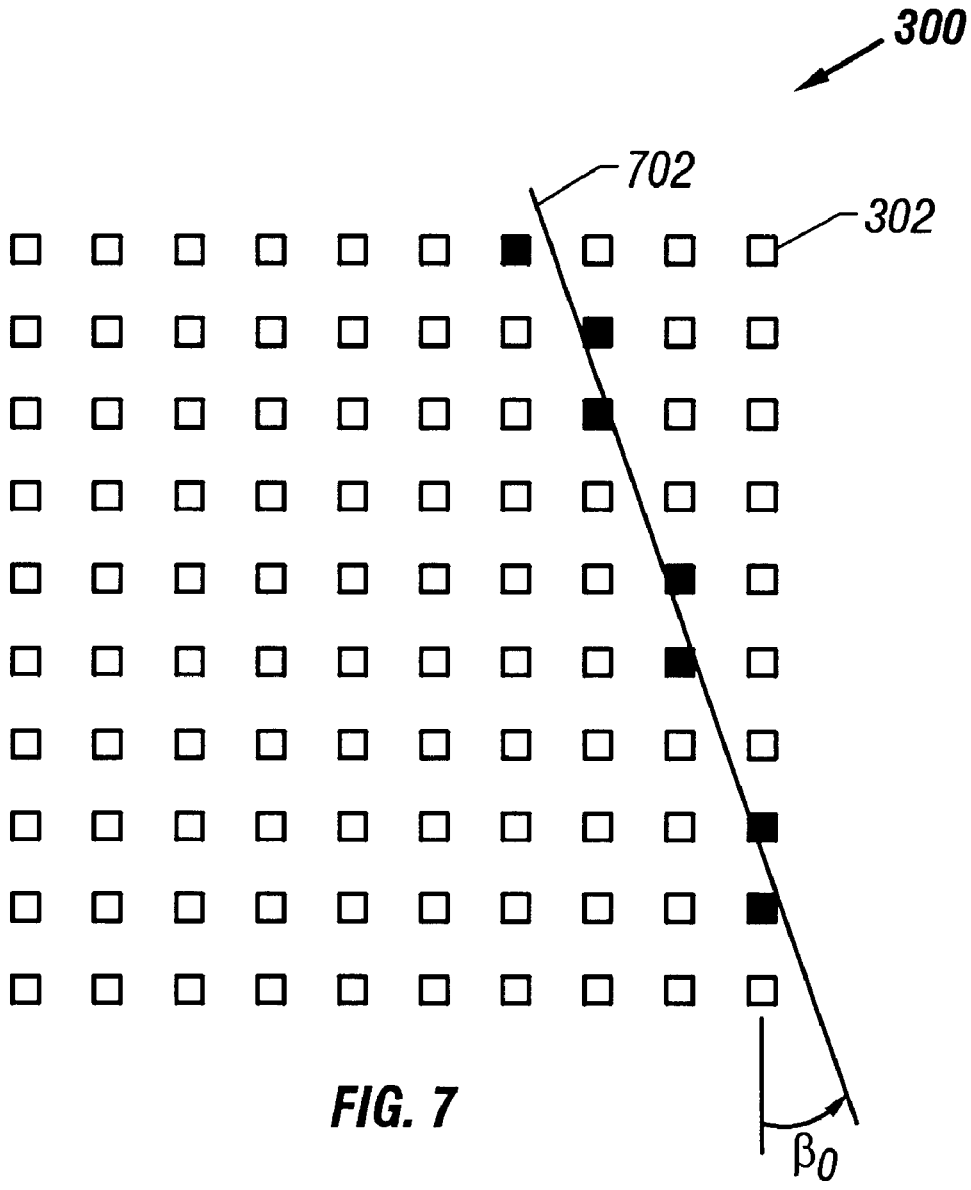
FIG. 7 is a diagram of a wavefront projection on the patch antenna array of FIG. 3 from sources at an azimuth $\beta=\beta_0$ defining antenna element ensembles oblique to the Y-axis.

FIG. 7 is a diagram of a wavefront projection 702 on the patch antenna array 300 of FIG. 3 from sources at directions $\beta=\beta_0$ oblique to the Y-axis. In this example, azimuth angle $\beta$ is not either of the convenient values of 0° and 90°, and the wavefront projections define element ensembles using more than one antenna element in each row. For example, if $||\beta|-90°|>45°$, the selected antenna elements for each element ensemble are grouped by rows, otherwise by columns. Since the number of antenna elements in each element ensemble may vary, a normalization of each element ensemble may be performed by dividing each element ensemble sum by the number of elements in the corresponding element ensemble. The shaded elements in the ensemble shown may be selected, for example, by calculating the nearest element to the wavefront projection 702 in each row, or by interpolating between the two elements nearest the wavefront projection 702 on either side according to well-known techniques.

Figure 8:
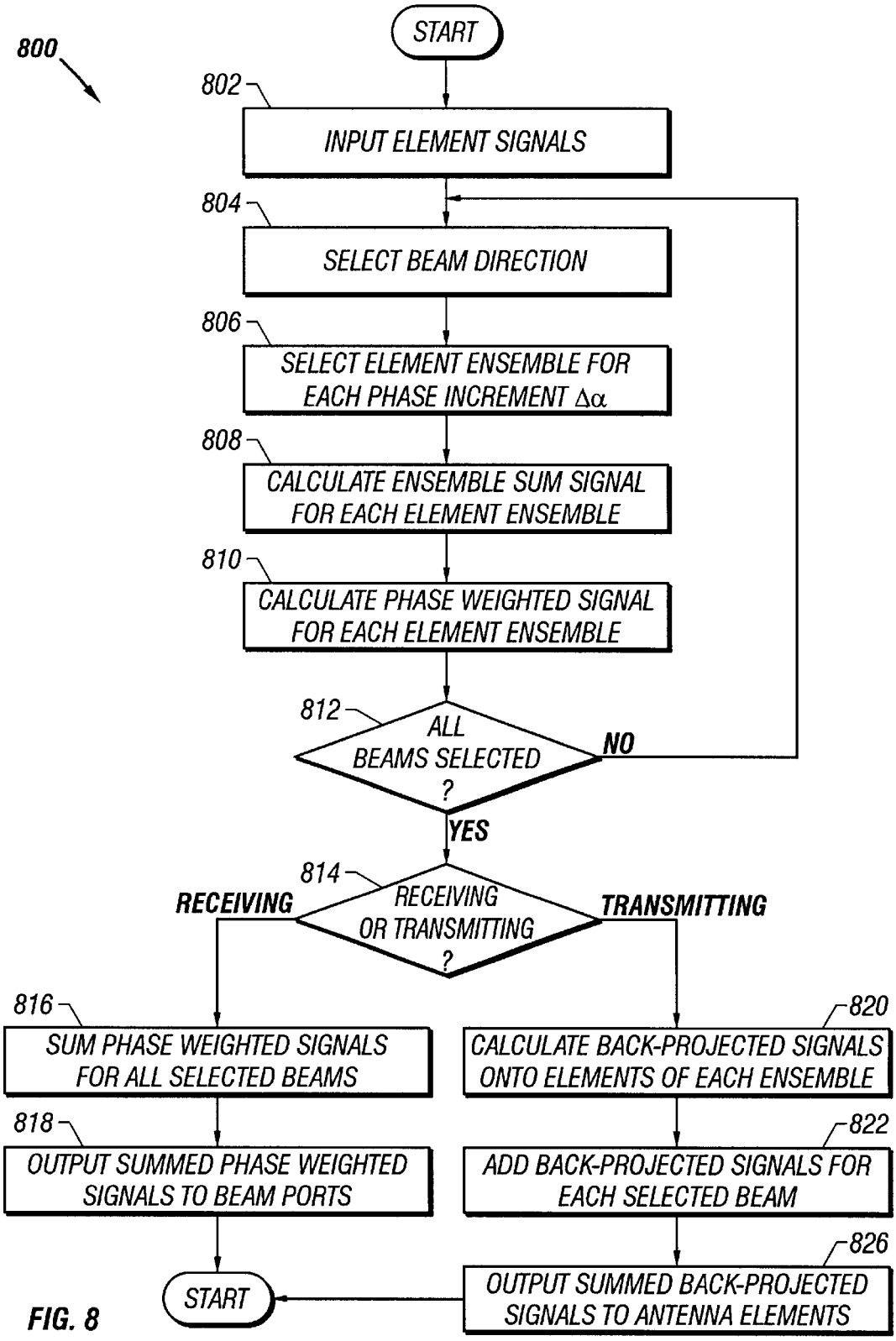
FIG. 8 is an exemplary flow chart for forming beams associated with the wavefront projections of FIGS. 5, 6, and 7 according to an embodiment of the present invention.

FIG. 8 is an exemplary flow chart 800 for beamforming according to an embodiment of the present invention. Step 802 inputs element signals for all antenna elements. Step 804 selects a desired beam direction. Step 806 selects an element ensemble that substantially coincides with a wavefront projection on the array for a beam having a selected elevation and azimuth for each phase increment $\Delta\alpha$. Step 808 calculates an ensemble sum signal, or wavefront projection signal, for each element ensemble. Step 810 calculates a phase weighted projection signal for each element ensemble according to phase increment $\Delta\alpha$. Step 812 loops back to step 804 until all desired beams have been selected. Step 814 selects either the receive mode for receiving a beam signal or the transmit mode for transmitting a beam signal. In the receive mode, step 816 sums the phase weighted projection signals for all selected beams. Step 818 outputs the summed phase weighted projection signals to the corresponding beam ports. In the transmit mode, step 820 calculates a back-projection signal of the phase compensated beam signal onto the elements of each element ensemble corresponding to the desired direction for each selected beam. Step 822 adds the back-projected signals for each selected beam for each antenna element. Step 826 outputs the summed back-projected signals to the corresponding array elements.

The calculation of the back-projection signal in step 820 used to compute the element signals in the transmit mode is exactly the reverse of the procedure for forming a beam in the receive mode. A single transmit signal is divided by the same phasors used above to form the receive beam. These phasors are computed from the elevation of the desired beam by the same procedure described above for the receive beam. In this example, there are ten such projected values to be computed. Each element of the array is then associated with one of these projected values, i.e., assigned to an ensemble, in the same manner as would be done in order to form a receive beam in the same direction. The projected values are applied to the associated elements without modification. The resulting element signals are then summed over all the transmit beams.

Figure 9:
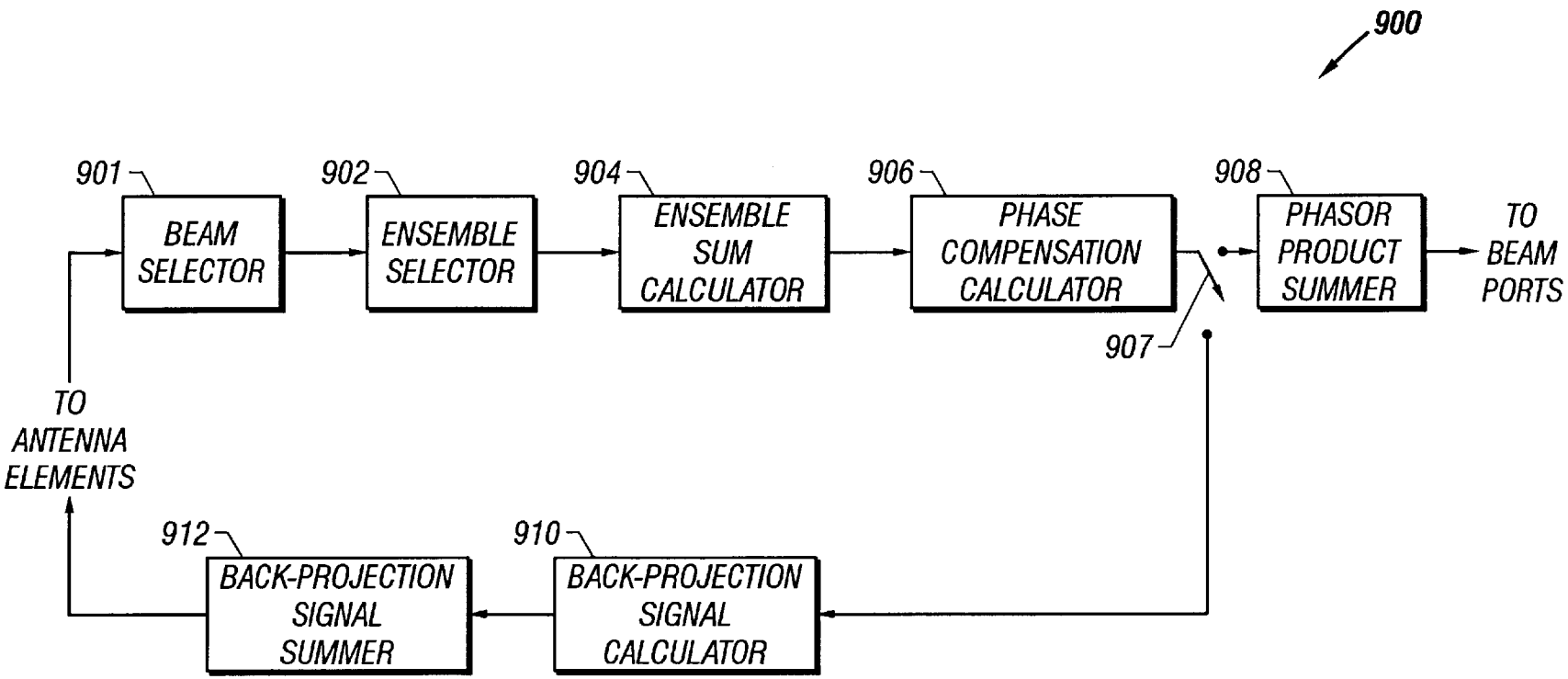
FIG. 9 is a block diagram of a beamformer according to another embodiment of the present invention.

FIG. 9 is a block diagram of a beamformer 900 according to an embodiment of the present invention. A beam selector 901 selects each desired beam direction. An ensemble selector 902 selects ensembles of antenna elements that substantially coincide with a signal wavefront projection on the antenna array for each selected beam having a selected elevation and azimuth for each phase increment $\Delta\alpha$. An ensemble sum signal calculator 904 calculates a normalized ensemble sum signal for each element ensemble for each selected beam. A phase compensation calculator 906 calculates a phase weighted projection signal corresponding to the wavefront projection for each ensemble sum signal. A transmit/receive switch 907 selects either the transmit mode or the receive mode. For receiving a beam, a phasor product summer 908 adds the phase weighted projection signals to form the selected beams concurrently and outputs the summed phase weighted projection signals to the corresponding beam ports. For transmitting a beam, a back-projected signal calculator 910 calculates a back projection signal for each phase weighted projection signal. A back-projection signal summer 912 adds the back-projected signals for the selected beams and outputs the summed back-projected signals to the antenna elements.

Other modifications, variations, and arrangements of the present invention may be made in accordance with the above teachings other than as specifically described to practice the invention within the spirit and scope of the following claims.

What is claimed is:

1. A method for beamforming comprising the following steps:

(a) selecting a beam elevation and azimuth; and (b) grouping elements of an antenna array into element ensembles that are substantially aligned with a wavefront projection on the antenna array corresponding to the selected beam elevation and azimuth.

2. The method of claim 1 further comprising the step of (c) calculating an ensemble signal sum for each of the element ensembles.

3. The method of claim 2 further comprising the step of (d) calculating a compensation phasor for each of the element ensembles from a phase progression increment to generate a phase weighted projection signal for each of the element ensembles.

4. The method of claim 3 further comprising the step (e) of summing the phase weighted projection signals.

5. The method of claim 4 further comprising the step (f) of outputting the summed phase weighted projection signals to a corresponding beam port for the selected beam elevation and azimuth.

6. The method of claim 1 further comprising the step (c) of calculating a back-projection signal onto the elements of each of the element ensembles.

7. The method of claim 6 further comprising the step (d) of outputting the back-projection signal to the antenna elements.

8. The method of claim 7 wherein multiple back-projection beams are calculated and added at the antenna elements to form a summed back-projection signal.

9. The method of claim 7 further comprising the step (e) of outputting the summed back-projection signal to the antenna elements.

10. The method of claim 2 wherein step (c) comprises normalizing each of the element ensemble sums by the number of elements in each of the element ensembles respectively.

11. The method of claim 1 wherein step (b) comprises calculating the wavefront projection on the antenna array corresponding to a phase correction value for each of the element ensembles.

12. The method of claim 11 wherein step (a) comprises associating selected antenna elements with a particular wavefront projection.

13. The method of claim 12 wherein the selected antenna elements associated with each wavefront projection respectively define the element ensembles.

14. The method of claim 12 wherein the selected antenna elements are grouped by rows if $||\text{azimuth}|-90°|>45°$ and by columns otherwise.

15. The method of claim 14 wherein two antenna elements from each group are interpolated to the position of the wavefront projection.

16. The method of claim 15 wherein each element ensemble contains all of the interpolated values from each group for a particular wavefront projection.

17. The method of claim 1 wherein the antenna array is mounted on a stratospheric platform.

18. The method of claim 17 wherein the antenna elements are linked to a ground station.

19. A beamformer comprising:

a beam selector for selecting a desired beam elevation and azimuth; and an ensemble selector for grouping elements of an antenna array into element ensembles that are substantially aligned with a wavefront projection on the antenna array corresponding to the selected beam elevation and azimuth.

20. The beamformer of claim 19 further comprising an ensemble sum calculator for calculating an element ensemble sum signal for each element ensemble.

21. The beamformer of claim 20 wherein the ensemble sum calculator normalizes the element ensemble sum signal for each element ensemble.

22. The beamformer of claim 20 further comprising a phase compensation calculator for calculating a phase weighted projection signal for each element ensemble.

23. The beamformer of claim 22 further comprising a phasor product summer for summing the phase weighted projection signals.

24. The beamformer of claim 19 further comprising a back-projection signal calculator for calculating a back-projection signal for each antenna element from the phase weighted projection signals.

25. The beamformer of claim 24 further comprising a back-projection signal summer for summing multiple back-projection signals at each antenna element corresponding to different transmit beams.

26. The beamformer of claim 20 wherein the ensemble selector calculates the wavefront projection on the antenna array corresponding to a phase correction value for each of the element ensembles.

27. The beamformer of claim 26 wherein the ensemble selector associates selected antenna elements with the wavefront projection.

28. The beamformer of claim 27 wherein the selected antenna elements are grouped by rows if $||\text{azimuth}|-90°|>45°$ and by columns otherwise.

29. The beamformer of claim 28 wherein two antenna elements from each group nearest to the wavefront projection are interpolated.

30. The beamformer of claim 28 wherein the element ensemble contains the interpolated value from each group.

31. The beamformer of claim 28 wherein each element ensemble contains the two antenna elements from each group nearest to the wavefront projection.

32. The beamformer of claim 19 further comprising a stratospheric platform on which the antenna array is mounted.

33. The beamformer of claim 19 further comprising a ground station linking the beamformer to the stratospheric platform.

* * * * *

UNITED STATES PATENT AND TRADEMARK OFFICE

CERTIFICATE OF CORRECTION

PATENT NO. : 6,380,893 B1 
DATED : April 30, 2002
INVENTOR(S) : Donald C. D. Chang et al.

It is certified that error appears in the above-identified patent and that said Letters Patent is hereby corrected as shown below:

Title page,
Item [56], References Cited, OTHER PUBLICATIONS, delete "U.S. application No. 09/655,041, Chang et al., filed Sep. 5, 2000" should read
-- U.S. application No. 09/652,862, Chang et al., filed August 31, 2000 --.

Signed and Sealed this

Fourteenth Day of October, 2003

JAMES E. ROGAN
*Director of the United States Patent and Trademark Office*